United States Patent [19]

Heidmann et al.

[11] Patent Number: 4,671,165

[45] Date of Patent: Jun. 9, 1987

[54] SIGHTING DEVICE FOR FIREARM WITH CORRECTION OF TARGET LATERAL MOVEMENT

[75] Inventors: Richard Heidmann; Pierre Miquet, both of Vernon, France

[73] Assignee: Societe Europeenne de Propulsion, Puteaux, France

[21] Appl. No.: 684,842

[22] Filed: Dec. 21, 1984

[30] Foreign Application Priority Data

Dec. 28, 1983 [FR] France ..... 83 20949

[51] Int. Cl.[4] ..... F41G 3/06; F41G 3/08

[52] U.S. Cl. ..... 89/41.19; 235/416; 356/252; 364/423

[58] Field of Search ..... 33/237, 238, 239; 89/41.06, 41.19; 235/414, 416, 418; 356/251, 252; 364/423

[56] References Cited

U.S. PATENT DOCUMENTS

| | | | |
|---|---|---|---|
| 3,059,338 | 10/1962 | Coeytaux | 89/41.19 |
| 3,298,281 | 1/1967 | Haglund | 89/41.19 |
| 3,960,453 | 6/1976 | Arnold et al. | 356/252 |
| 4,145,952 | 3/1979 | Tye | 364/423 |
| 4,404,890 | 9/1983 | McAlpine | 356/252 |

FOREIGN PATENT DOCUMENTS

| | | |
|---|---|---|
| 1034598 | 7/1953 | France . |
| 1403402 | 5/1965 | France . |
| 2371735 | 6/1978 | France . |
| 2440537 | 5/1980 | France . |

*Primary Examiner*—Stephen C. Bentley
*Attorney, Agent, or Firm*—Weingarten, Schurgin, Gagnebin & Hayes

[57] ABSTRACT

The sighting device comprises first means for displaying at least one displacement mark parallel to the central vertical spider-line, means for altering the position of said displacement mark, means for measuring the target moving time which has elapsed between one initial moment at which the target seen in the range finder is superimposed with a reference mark, and a subsequent moment at which said target seen in the range finder held in immobilized position reaches said displacement mark; and second means for displaying at least one cross velocity adjusted mark, parallel to said central vertical spider-line, and whose position is determined first as a function of the projectile flight time, which is itself determined from the firing distance, and second, as a function of the target moving time, measured for a given displacement mark.

12 Claims, 29 Drawing Figures

Figure 1A:
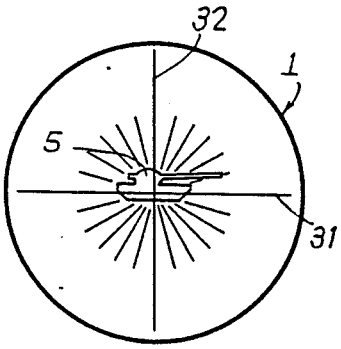
Figure 1B:
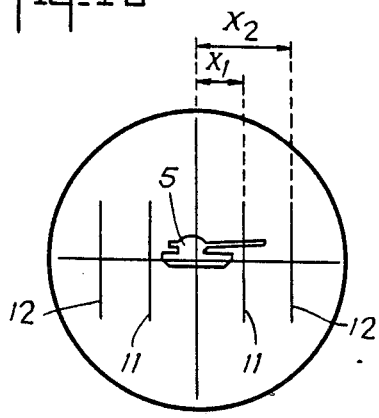
Figure 1C:
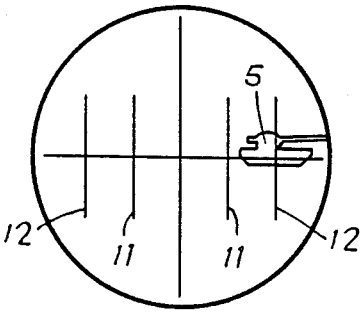
Figure 1D:
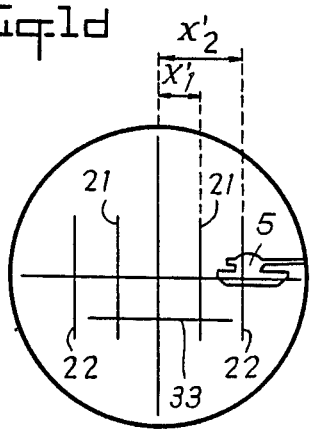

A
VIEWING TARGET
B
TRIGGERING
RANGE FINDER
C
DISPLAY OF DISPLACEMENT MARKS
D
STOPPING CHRONOMETER
E
DISPLAYING CORRECTED FIRING MARKS
F
FIRING
COMPUTER
G
H
TRANSFER OF D
CALCULATION
I
JK
CALCULATION OF CORRECTIONS
L
TRANSFER OF $t_0$
CHRONOMETER
M
RESET
N
$t_0$

Fig. 6a
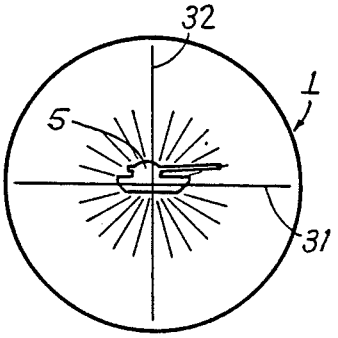
Fig. 6b
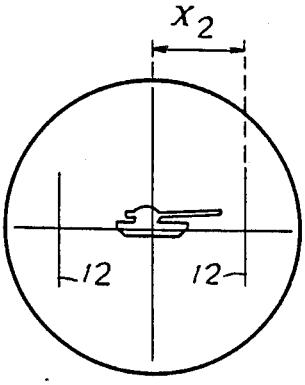
Fig. 6c
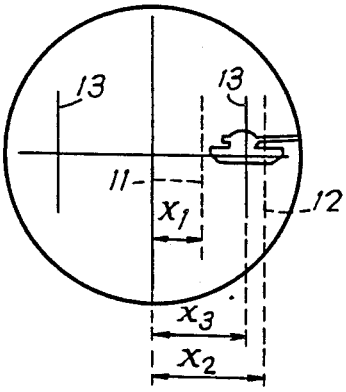
Fig. 6d
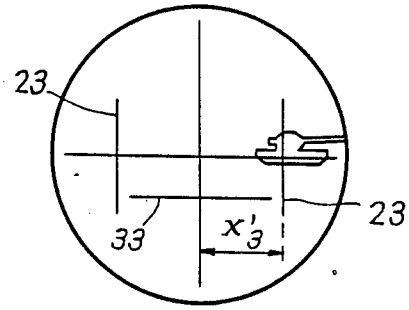
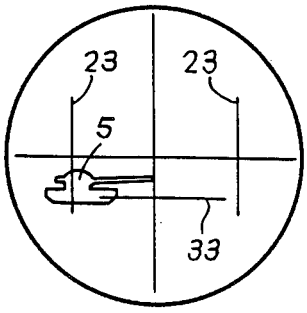
Fig. 6e A
VIEWING TARGET
B
TRIGGERING CHRONOMETER
C
STOPPING CHRONOMETER
D
RANGE FINDING
E
DISPLAYING CORRECTED FIRING MARKS
F
FIRING

COMPUTER
CALCULATION OF CORRECTIONS

CHRONOMETER
RESET
F
$t_o$
TRANSFER OF $t_o$

SIGHTING DEVICE FOR FIREARM WITH CORRECTION OF TARGET LATERAL MOVEMENT

The present invention relates to a sighting device for firearms with correction of target lateral movement, comprising a range finder, a computer, time-measuring means and means for displaying the firing parameters within the focal plane of the sighting system.

The invention relates more particularly to sighting devices provided with means for measuring the angular speed of the sighted target as well as means for correcting the deviation caused by that angular speed.

Various known systems of this type comprise an actual tachometer system complete with angle encoders or gyrometers. These systems however are generally complex and little adapted to infantry weapon of wide diffusion.

In other known systems, the firearm operator has to estimate the projectile flight time and, keeping his firearm still during the measurement, to estimate the angular speed of the target by watching its displacement during the flight time on a horizontal reference mark scale engraved on the graticule of the sighting telescope, then he shifts his aiming point, in the opposite direction, by the same number of divisions as covered by the target.

These simplified devices have the disadvantage of involving an estimate of the flight time by the operator, hence an incorrect determination of the angular speed.

In other known, more precise, systems, the firearm operator applies the same method as in the aforesaid simplified devices, except that he is informed exactly of the projectile flight time by a signal light, said time being obtained by a measurement of distance.

Said devices also have a number of disadvantages. In particular, they require a relatively important number of graduation marks to obtain a really accurate estimate of the speed, this leading to locating difficulties and confusions. They also require a mental and physical operation to carry the final sighting point over an equal number of divisions in the reverse direction to that of the monitored displacement, which can lead to difficulties with inexperienced staff. Moreover, these devices lead, with long ranges, to an observation time (which is necessarily equal to the flight time), which can impair the duration of the intervention.

In another known sighting device, the target displacement marks, constituted by points situated on the horizontal spider-line at a predetermined fixed distance from the vertical spider-line are displayed in the focal field to enable to determine the time of displacement corresponding to the time taken by the target image to move, in the focal field, from the vertical spider-line to one of the displacement marks, the knowledge of the firing distance determined by range finding and that of the target time being then used to work out and display the cross velocity adjusted marks which take into account the displacement of the target during the time of travel of the projectile.

Such a sighting device does not however account for the various possible speeds at which the target moves in the focal field, which can lead either to too long a measuring time for determining the target displacement time and as a result for displaying the cross velocity adjusted marks or to an inaccurate measurement, because it corresponds to a target displacement time which is too short in view of the operator's reaction.

It is an object of the present invention to overcome the aforesaid disadvantages and to propose a simplified range finder with a reduced number of markings, whilst simplifying the target angular speed estimate, by increasing its accuracy and reducing the time of the intervention.

It is thus an essential object of the invention to make the sighting process simpler as well as quicker and more reliable, whilst eliminating the need of all mechanical moving parts for measuring and correcting the target lateral displacement.

These objects are reached with a firearm sighting device with correction of target lateral movement, of the type comprising a range finder, a computer, time measuring means, first means for displaying at least one displacement mark within the focal plane of the sighting device at one given spot on the horizontal spider-line, and second means for displaying at least one cross velocity adjusted mark within the focal plane of the sighting system according to a position on the horizontal spider-line determined, on the one hand, in relation to the projectile flight time, which is itself determined from the firing distance measured, and on the other hand, in relation to the target displacement time measured for a given displacement mark with respect to a reference mark situated in one given spot on the horizontal spider-line which is different from the spot where the displacement mark is situated, using means for measuring the target displacement time which has elapsed between a first actuation by the firearm operator of a member controlling the time measuring means and the display means of a displacement mark and a subsequent time, indicated by the operator, and corresponding to a second actuation of said member controlling the time measuring means at the moment when the target seen in the sighting device which is held in a fixed position, has completed its run between the reference mark and the displacement mark, device characterized in that the first actuation of said member controlling the time measuring means and display means causes the display of a first displacement mark in the focal plane of the sighting device at a relatively great distance from the reference mark and in that, without another actuation of said time measuring means and display means control member after a predetermined time interval, the displacement mark display means cause the displacement of said mark in the focaling plane of the sighting device to within a relatively small distance from the reference mark.

According to one advantageous feature of the device according to the invention, the displacement of the target movement mark is progressive and takes place at an increasing speed from the position of the first displacement mark to a final position corresponding to a relatively short distance from the reference mark.

Preferably, the sighting device comprises means of erasing the displacement marks, which are used when there is no further actuation of the time measuring means control member after a preset time interval, and which may be between, for example, one and three seconds.

According to a possible embodiment of the invention, the range finding measurement permitting to determine the position of a cross velocity adjusted mark, is carried out after the time measurement.

According to another possible embodiment of the invention, the range finding measurement permitting to determine the position of a cross velocity adjusted mark is conducted before any time measurement, and the first means for displaying at least one displacement mark are so designed as to display a displacement mark at a distance from the reference mark which is determined in relation to the firing distance given by the range finder so as to correspond to a predetermined distance inside a plane perpendicular to a sighting axis and containing the target.

In particular, the time measuring control member can be constituted by the range finder control knob and the second actuation of the control member can then correspond to a release of said range finder control knob.

According to a particular embodiment of the invention, the reference mark is constituted by the central vertical spider-line.

According to another embodiment of the invention, said reference mark is constituted by a mark which is laterally shifted from said vertical spider-line and said displacement mark is first displayed on or close to said vertical spider-line, during the first actuation of said time measuring means and display means control member, then, if there is no further actuation of said time measuring means and display means control member after said predetermined time interval, said displacement mark is moved progressively to a relatively small distance from the reference mark which is away from the central vertical spider-line.

Said displacement marks, reference marks and cross velocity adjusted marks can be disposed in pairs, symmetrically with respect to the central vertical spider-line, in such a way as to enable target sighting without the operator having to give any information as to the direction in which the target moves.

Advantageously, the reference marks, displacement marks and cross velocity adjusted marks are constituted by segments parallel to the central vertical spider-line.

According to another feature of the invention, the sighting device comprises means for measuring or detecting the inclination threshold, as well as means for correcting the lead in relation to the measured inclination.

According to a special embodiment of the invention, a first actuation of the time measuring means and display means control member causes the display of a first displacement mark in the focal plane of the sighting device at a relatively long distance from the reference mark, then, successively or simultaneously, the display of a second displacement mark at a relatively short distance from the reference mark.

Figure 1E:
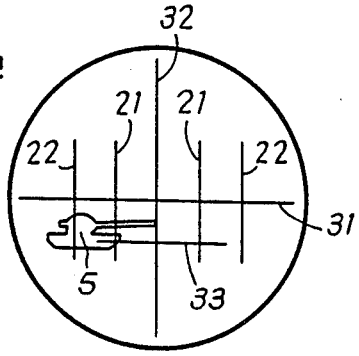
Figure 2:
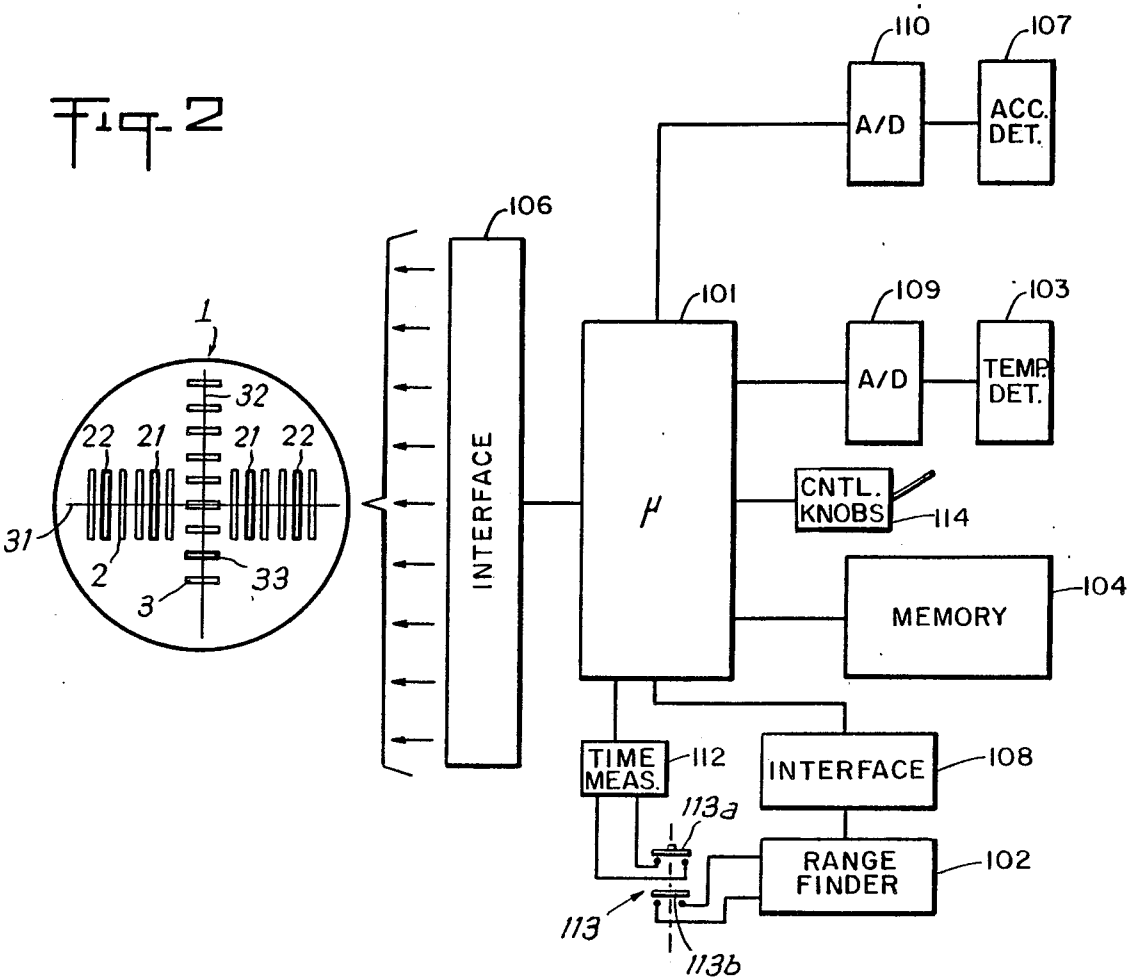
Figure 3:
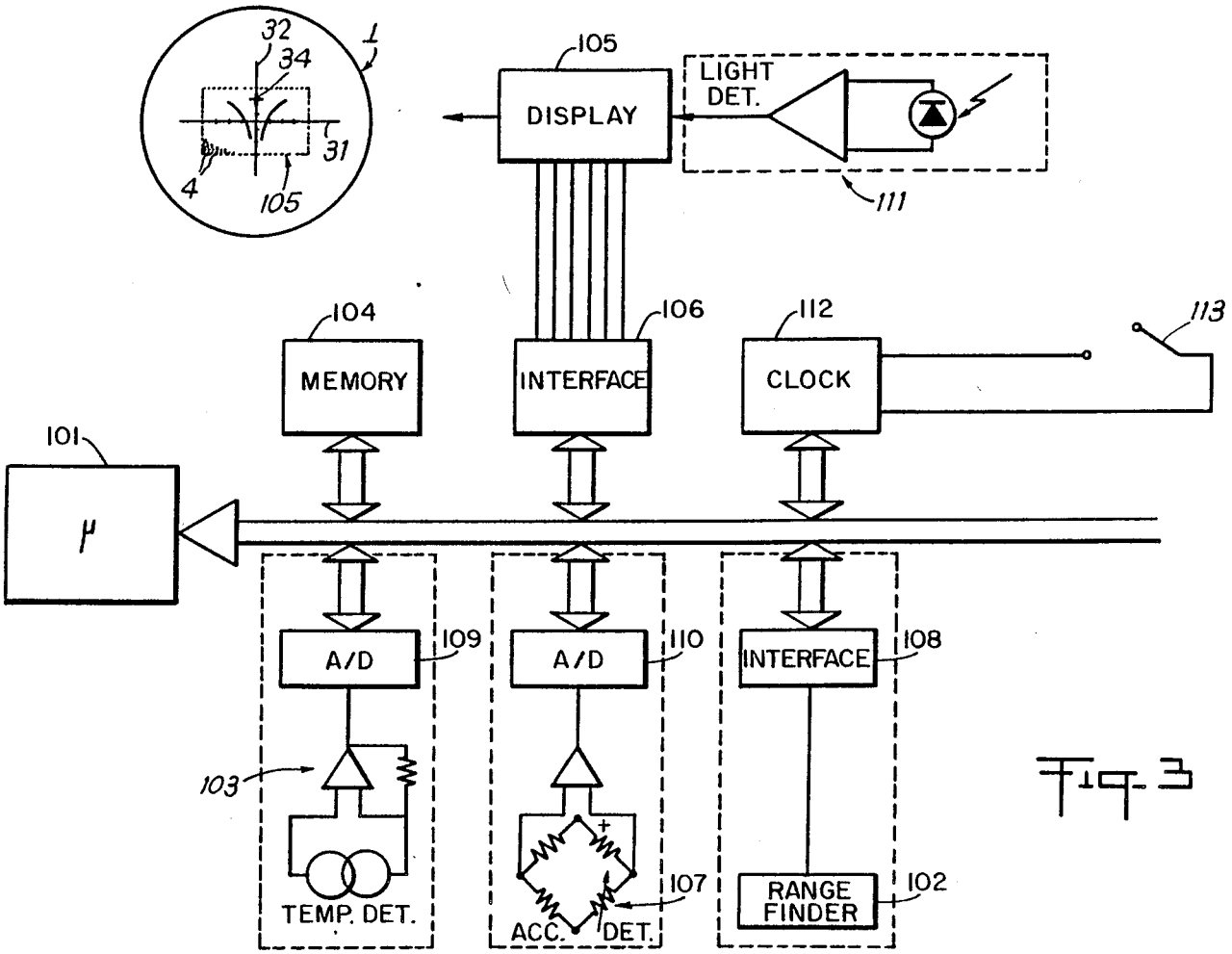
Figure 4:
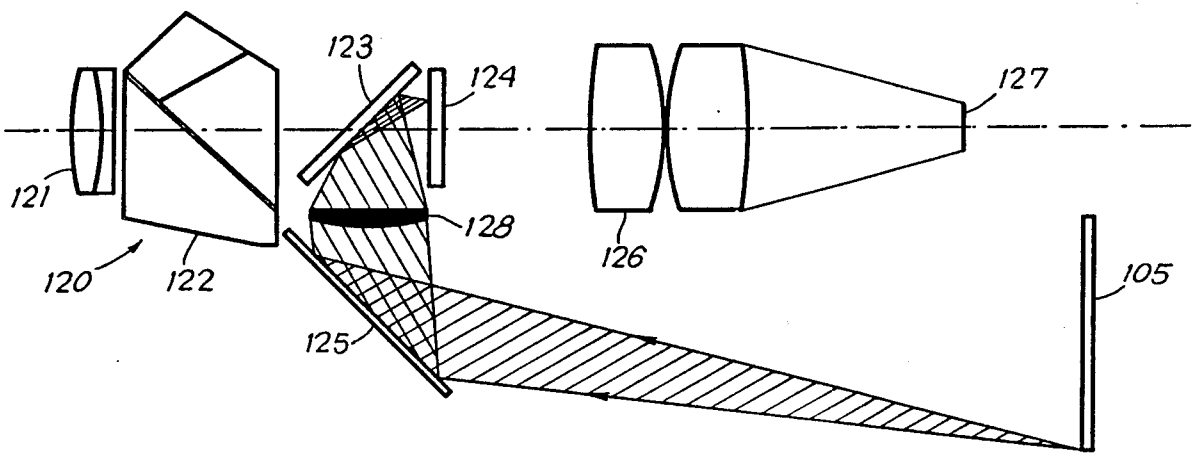
Figures 5A, 5B, 5C:
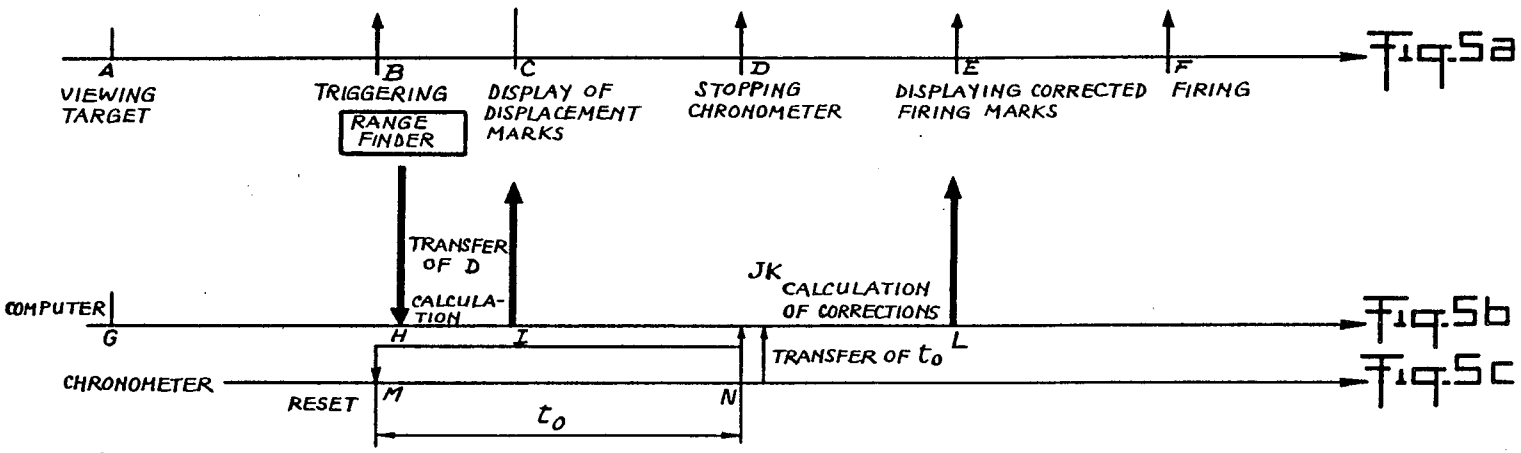
Figures 7A, 7B, 7C:
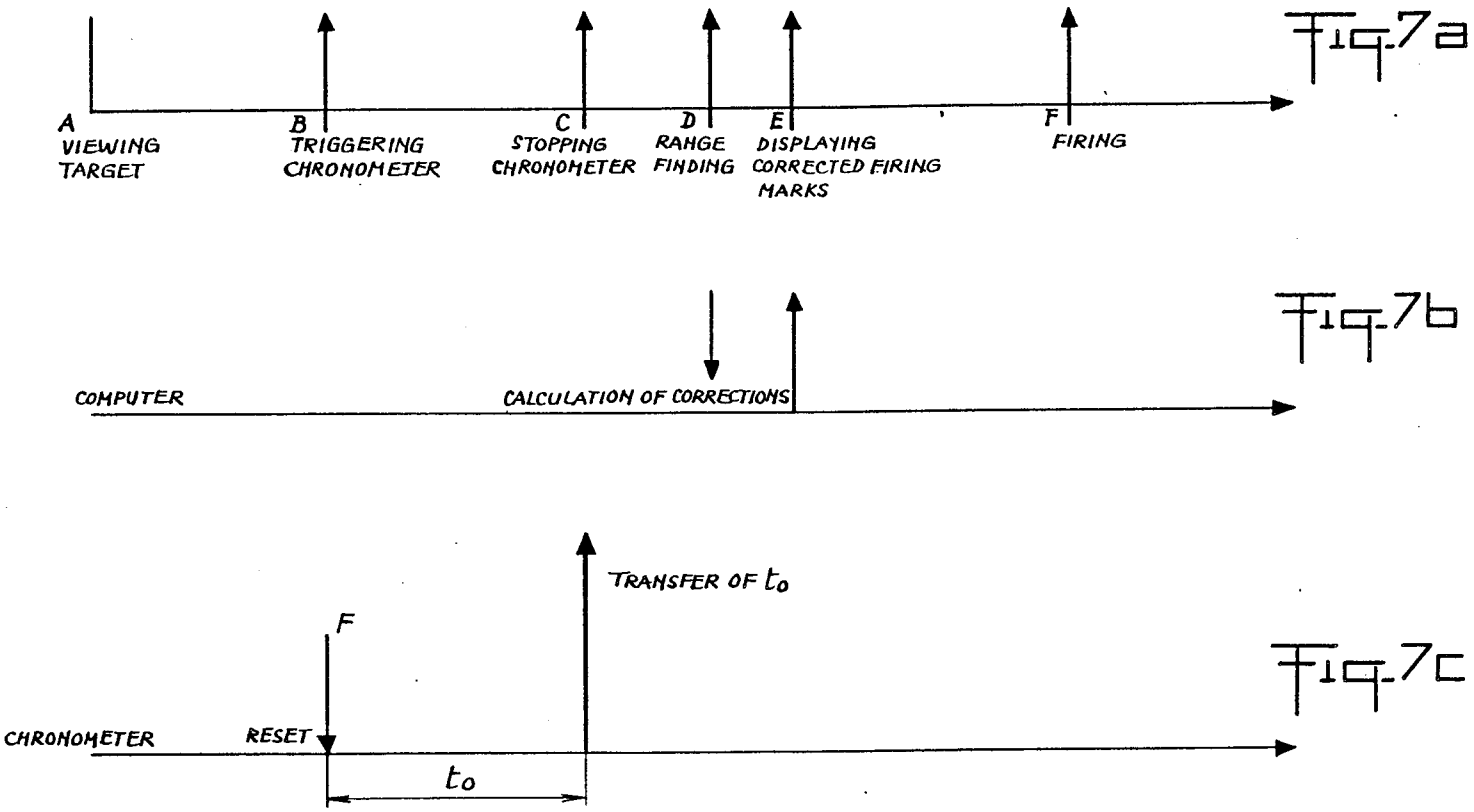

The invention will be more readily understood on reading the following description with reference to the accompanying drawings in which:

FIGS. 1*a* to 1*e* show the different successive images seen in the sighting device during a sighting sequence according to a first embodiment of the invention, FIG. 2 is a simplified block-diagram of the sighting device according to the invention with a first type of graticule, FIG. 3 is a simplified block-diagram of the sighting device according to the invention with a number of variants and a second type of graticule, FIG. 4 shows the optical part of the sighting device according to the invention, FIGS. 5*a* to 5*c* show time charts of how the different parts of the sighting device according to the invention work, according to one possible type of sequence, FIGS. 6*a* to 6*e* show the different successive images seen in the sightingdevice during one sighting sequence according to a second embodiment of the invention, FIGS. 7*a* to 7*c* show the time charts of how the different parts of the sighting device according to the invention work according to another possible type of sequence, FIGS. 8*a* to 8*e* show the different successive images seen in the sighting device during a sighting sequence according to a third embodiment of the invention, and FIGS. 9*a* to 9*e* show the different successive images seen in the sighting device during a sighting sequence according to a second embodiment of the invention.

The sighting device according to the invention is constituted of different sub-assemblies showed symbolically in FIGS. 2 and 3. Said device essentially comprises a sight 120 giving a somewhat enlarged view, three to five times for example, of the land and of the target, and comprising a graticule whose center is determined by the optical axis and the axis of transmission of a laser range finder 102. Said laser range finder 102 may itself be separate from the sight, or preferably, use certain optical parts in common with the sight.

Display means 105, for example based on electroluminescent diodes, operationally coupled with a semi-reflecting plate 123 (FIG. 4) permit to bring, in the focal plane of the sight 120 different marks as well as the elevation line, which will thus be displayed on the graticule 1.

The sight 120 can be a conventional one with a lens 121, a rectifying prism 122, a graticule 124, and an eyepiece 126 with its collar 127, and, in addition, a dividing plate 123, a lens 128 and a flat mirror 125 to permit the projection, on the graticule, of the different marks of the display means 105, as indicated hereinabove.

Said display means 105 may be constituted by a mosaic of light points 4 arranged in matrix form (FIG. 3). Said display means 105 then comprise an electroluminescent plate associated to a liquid crystal mosaic. According to another possible embodiment (FIG. 2), the display means 105 comprise two cross-shaped bars, each one constituted of a plurality of electro-luminescent diodes 2,3. The diodes 2 of the first bar are aligned on horizontal spider-line 31 and parallel together and to the central vertical spider-line 32. The diodes 3 of the second bar are, on the contrary, aligned on the vertical spider-line 32, parallel together and to the horizontal spider-line 31. As indicated hereinafter, the diodes 2 of the first bar permit the display of marks 21, 22 to measure the lateral moving speed of the target whereas the diodes 3 of the second bar are designed to permit the display of elevation marks 33.

The sighting device according to FIGS. 2 and 3 further comprises a computer 101, formed for example from a micro-processor, and used in particular for determining the position of the different marks to be displayed by the display means 105 in relation to the input data supplied to the sighting device by the operator or by the detectors associated to said device.

An ambient temperature sensor 103 is preferably adjoined to the sighting device for a more accurate calculation of the elevation.

It is also advantageous to incorporate an inclination detector 107 which may be an accelerometer, but is preferably a level with contacts which constitutes a threshold detector working by gravity (for example with mercury) in order to reduce costs and to increase reliability. Said level can of course be completed by a spirit level, which is visible to the operator, in order to enable the latter to place himself in a position of substantially nil inclination before the start of the firing sequence. The signals supplied by the inclination detector 107 can also be used for controlling means which can automatically correct the target displacement as a function of the measured inclination.

As an option, a detector 111 for measuring the ambient illumination can be adjoined to the sighting device to enable to regulate the supply to the display means 105, thus keeping a constant ratio between the luminance of the display means and the luminance of the background.

As illustrated in FIGS. 3 and 4, said optional temperature-measuring 103 and inclination measuring 107 detectors are connected to the computer 101 via analog-digital converters 109, 110 respectively. In addition, interface circuits 108, 106 are provided between, respectively, the range finder 102 and the display means 105, on the one hand, and the computer 101 on the other. Memories 104 for recording an arithmetic programme and different parameters are also associated to the computer 101. A time measuring device 112 and control knobs 113, 114 further complete the sighting device shown in FIGS. 2 and 3.

A description is now given of how a first special embodiment of the device according to the invention works, embodiment which is designed to achieve successive display in the sighting device of displacement marks 11, 12 to enable the operator to readily determine the moving speed of the target in the sight (FIGS. 1*b*, 1*c*) and of cross velocity adjusted marks 21, 22 (FIGS. 1*d*, 1*e*) which, added to elevation mark 33, should enable to correctly aim the firearm, taking into account all the possible parameters.

A known important factor is to be able to estimate, not only the distance between the target and the firearm, using a range finder (FIG. 1*a*), in order to set a flight time for the projectile, but also to accurately estimate the speed of lateral movement of the sighted target in order to avoid that the projectile passes in front of the target, if the real speed of the latter is below the estimated value, or behind the target, if the real speed of the latter is higher than the estimated value. The problem lies in the fact that the target displacement has to be measured quickly by the firearm operator. Yet, it is difficult to anticipate whether the target about to appear is far from or close to the the operator and whether its moving speed is low or high.

The known method, in this case, is to provide in the sight, symmetrically to the vertical spider-line, two fixed displacement marks which are engraved on the sight graticule on either side of the vertical spider-line or displayable at a preset distance therefrom. The firearm operator who watches the movement of the target in the sight can then, by using a special control, associated to a chronometer, inform the computer of the displacement time necessary to the target to complete the distance in the sight, between the vertical spider-line and one of said symmetrical marks. The measure of the distance of the target given by the range finder, thereafter enables the computer to determine the moving speed of the target which is known as angular speed.

The major disadvantage of this embodiment lies in the fact that, in this case, the measuring times are very variable depending on the distances, namely they are very short for short distances with high target speeds, and excessively long for long distances with low target speeds, this interfering with the time of intervention.

In order to overcome the aforesaid disadvantage, the present invention recommends to adapt the position of the displayed displacement marks 11, 12 with respect to the vertical spider-line 32 (FIG. 1*b*) in order to obtain an optimized measuring time which is neither too long so as not to affect the time of intervention, nor too short, so as to remain accurate. This fact that the position of the adjusted displacement marks is adjustable constitutes an essential feature of the present invention.

Thus the presence of displacement marks 11, 12 of adjustable position, displayed selectively in the sight, enables in particular to predetermine the time for measuring the target moving speed. In the case where a range finding measurement of distance is conducted first (FIG. 1*a*), it is possible after computer processing of the distance information, to adapt the angular distance X between the displayed displacement marks 11, 12 and the vertical spider-line, in order to optimize the measuring time. In this case, for small distances between target and weapon, the displacement marks will be away from the vertical spider-line; for greater distances, these marks will be closer to the vertical spider-line.

It is for example possible to choose the position $x_2$ of the displacement marks 12 so that this corresponds to the distance of the target 5, to a lead of 10 m, which for targets with lateral speeds of between 5 and 10 m/sec., corresponds to a speed measurement time of 1 to 2 secs.

But, this value, although satisfactory in a majority of cases, leads to a relatively long time of intervention for targets with lower lateral speeds (for example, a tank coming from three-quarter front). Yet it is impossible to reduce the lead of the marks 12, since this would entail, for the much higher speeds, too short a measuring time, which is bad for accuracy.

According to the invention, this limitation can be done away with if provision is made to display simultaneously or successively, in that order, two pairs of marks 12, 11 disposed symmetrically on either side of the vertical spider-line (FIG. 1*b*) respectively apart from the readings $X_2$ and $X_1$ and fulfilling the following conditions:

external mark 12 (reading $X_2$) should not be reached under less than a minimum value (such as for example 1 sec.) for targets 5 with a moving speed equal to the maximum reference value (which is for example 10 m/sec.), this in order that the accuracy of the target moving measurement, which is a function of the observation time, be not too downgraded;

inner mark 11 (reading $X_1$) should not be reached in more than a maximum value (such as for example 2 secs.) for targets moving at a speed equal to a minimum reference value which is for example 2.5 m/sec.), value below which the correction of the lead, which is relatively small, is left to the operator's judgement (tachymetry time limited to 2 secs.).

According to another variant of the invention illustrated in FIGS. 6*b* and 6*c*, only one pair of marks 12 is used, but with the following improvements:

marks 12 are initially placed in the position corresponding to the position of the external marks of the preceding variant (reading $X_2$) and this for a fixed period (such as for example 1 sec.) corresponding to the moving time of the target at its maximum reference speed (FIG. 6*b*);

if at the end of said preset period, the speed measurement sequence has not been interrupted by the operator, marks 12 are erased and new marks 13 (reading $X_3$) are then progressively moved from the above position to the position corresponding to that of the inner marks in the preceding variant (reading $X_1$), which they reach after the anticipated maximum speed measurement time (i.e. 2 secs.). It will be noted that the progressive movement of the marks 13 can then take place at a speed which increases as the marks 13 move away from the initial position of the marks 12, this permitting to optimize the speed measurement times.

The variant according to FIG. 6*b* and 6*c* combine the advantages of one solution using one pair of marks 11 or 12, i.e. simplicity of the modus operandi, since the firearm operator has in his focal plane only one mark indicating end-of-target displacement with respect to which he has to observe the movement of the target, with the advantages of another solution using two pairs of marks 11, 12, namely the reduction of the speed measurement time in the case of slow displacements.

An added precaution can consist in interrupting the display of the displacement marks 11, 12 or 13 after a maximum period of speed measurement, for example equal to 2 secs. which indicates to the operator that if the inner mark 11 (reading $X_1$) is not reached by target 5 at the end of that period, the lateral speed of said target is very small, and the correction of target lateral movement is left to his judgement.

In all cases, the duration of the operator's intervention for measuring the target moving speed will thus be limited to the maximum authorized period.

According to another embodiment illustrated in FIGS. 8*a* to 8*c* and 9*a* to 9*c* and corresponding to the sequence of FIGS. 7*a* to 7*c*, the target distance is not measured at the start of the operations, but at the end of the sequence (FIGS. 8*d* and 9*d*), this allowing a shorter time between the laser range finding liable to reveal the position of the operator, and the firing of the projectile (FIGS. 8*e* to 9*c*). In this case, the displacement marks 52 respectively 12 (FIGS. 8*a* respectively 9*a*) are first displayed in fixed manner for a predetermined period at a fixed distance $y_o$ respectively $y'_o$ which is relatively remote from a fixed reference mark 42 respectively 32, which may be engraved, then they move (marks 53 respectively 13) towards the reference marks 42 respectively 32 to reduce the angular space between the marks of the start-of-displacement mark 42 respectively 32 and the end-of-displacement mark 53 respectively 13 (reading y1 in FIG. 8*b* and y'1 in FIG. 9*b*) and minimize the time of speed measurement.

Figure 8A:
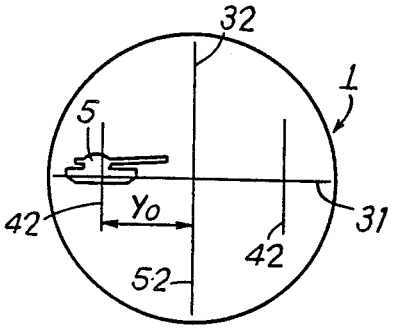
Figure 9A:
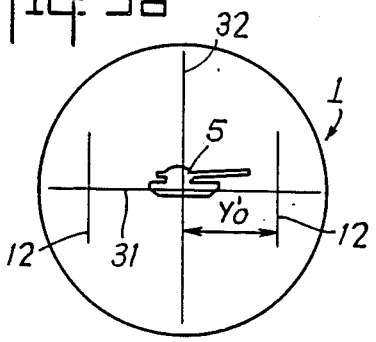
Figure 9B:
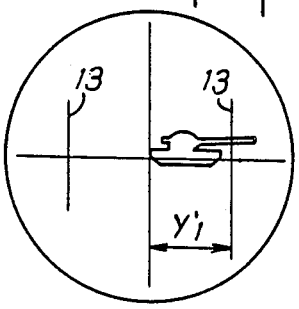
Figure 9C:
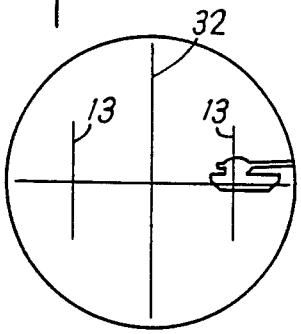

In general, the sequence for determining the target moving speed is as follows:

The operator aims on the target 5 the cross formed by the initial displacement mark which may be the vertical spider-line 32 (FIGS. 1*a*, 6*a*, 9*a*) or an engraved mark 42 situated towards the outside of the field, and by the horizontal mark 31. By pressing on a control knob 113*a*, he starts the chronometer, keeping then his firearm in immobilized position (FIGS. 8*a* and 9*a*). According to a special embodiment, this operation starts off the range finding at the same time (FIGS. 1*a* and 6*a*), the range finding control knob 113*b* being combined with the chronometry control knob 113*a*.

The operator, by actuating the member 113*a* controlling the triggering of chronometry and display, causes the display in the graticule 1 of displacement marks 11, 12 which can be adapted to the target distance known by computer 101 from the information supplied by range finder 102 (FIG. 1*b*), and designed to enable the measurement of the target moving speed with a maximum of accuracy and practicality, in a minimum time. The computer 101 thus controls the display, on either side of the central vertical line 32 of the graticule, of a fixed vertical mark 12 which can start moving 13 (FIGS. 6*b* and 6*c* and FIGS. 9*a* to 9*c*) or of several, preferably two, fixed vertical marks 11, 12 (FIG. 1*b*), also called displacement marks, by addressing corresponding display elements 2 or 4 of the display means 105.

It will be noted that the members 113*b*, 113*a* controlling the triggering of range finding and the triggering of time measurement and display are preferably coupled or combined into a single operating knob 113. Thus, the speed measurement sequence with display of the displacement marks and starting of the time measurement can be initiated without delay, as soon as the range finder is triggered, said range finder itself giving instantaneously an indication of the target distance. It will be noted that in the case where the range finding measurement is carried out after the time measurement (FIGS. 7*a* to 7*c*, 8*a* to 8*d* and 9*a* to 9*d*), it is also possible to use only one operation knob, a first actuation of said knob causing the triggering of the chronometry, a second actuation causing the stoppage of the chronometry and a third actuation causing the triggering of range finding. In this case, a resetting knob is associated to the system in order to permit re-initiating of a sighting sequence.

After display of the displacement marks, the operator keeps his firearm in immobilized position and watches the movement of target 5. When said target arrives on one of the fixed marks 11, 12, mark 12 for example (FIG. 1*c*) or when the target and one of the movable marks 13 are superimposed (FIGS. 6*c* and 9*c*), the operator stops the time-measuring operation by actuating a contact 113*a* provided to this effect, or, simply, in the case where said contact is combined with the range finding control knob 113*b*, by actuating or releasing said knob.

Figure 8B:
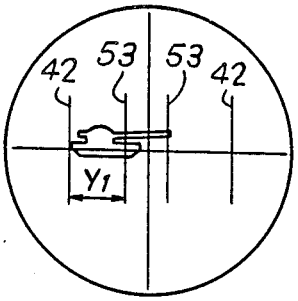
Figure 8C:
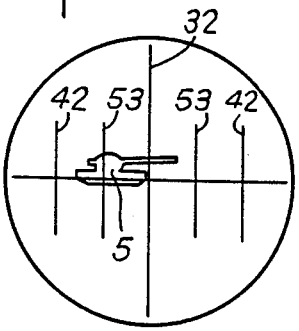

It will be noted that according to a variant embodiment of the invention, the end-of-time measurement marks 52 are first of all coinciding with the vertical spider-line 32 (FIG. 8*a*) or disposed symmetrically with respect to said line 32 and close thereto, then they move out of the focal plane (marks 53 in FIG. 8*b*) towards the fixed reference marks 42. Said marks 52, 53 of FIGS. 8*a* to 8*c* are thus similar to the aforesaid marks 12, 13.

Figure 8D:
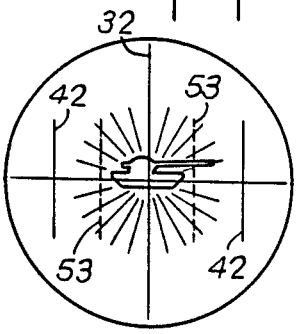
Figure 8E:
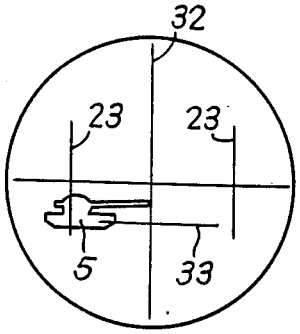
Figure 9D:
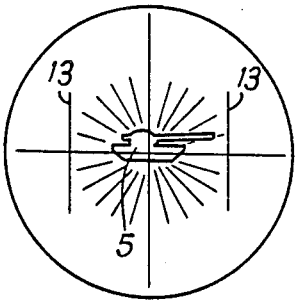
Figure 9E:
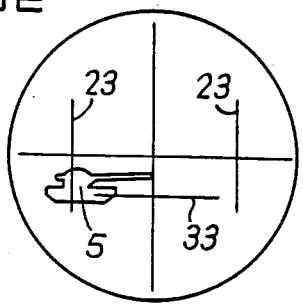

According to certain embodiments of the invention, the range finding operation is carried out after completion of the time-measurement (FIGS. 8*d* and 9*d*). In said embodiments, the moving laws of the displacement marks 53, 13 are predetermined and distance plays no part, but said laws can, if necessary, produce moving speeds which increase in relation to time.

At this point of the measuring sequence, the computer 101 knows the distance of the target, the target moving time for the angle corresponding to the moving mark 11, 12, 13 or 53 concerned, the projectile flight time which it has worked out in relation to the firing parameters which are mainly the distance of the target and the ambient temperature, and in some cases the inclination, measured or detected in relation to a threshold by the detector 107. Computer 101 then determines the horizontal angular shift (lead) of the aiming point to be displayed in order to fire on an adjusted mark after possible correction of its inclination. It also works out the vertical angular shift corresponding to the elevation. The moving marks 11, 12 or 13 are then erased and firing marks 21, 22 or 23 are then displayed by addressing display elements 2 or 4 closest to the calculated positions, amongst available discrete ramps (FIGS. 1*d*, 6*d*, 8*e*, 9*e*) (readings $X'_1$, $X'_2$ or $X'_3$). If it has not already been, the elevation mark 33 is also displayed by addressing display elements 3 or 4 farthest from the calculated positions.

It will be noted that, in the case where a particular indication has been given as to the target moving direction, the lateral firing marks 21, 22, 23 must be displayed left and right of the central line. It is however possible, with an extra control handle 114, for example a three-position handle (left, center and right) (FIG. 2) to supply manually to the computer an information giving the target moving direction, this permitting then to display the displacement marks 11, 12 and the cross velocity adjusted marks 21, 22 on one side only of the central vertical spider-line 32.

Moreover, in the case where the apparatus uses the display of two displacement marks 11, 12 on either side of the central line 32 (FIGS. 1*b*, 1*c*) there are two possible moving speeds which correspond to the measured moving time. Then two firing marks 21, 22, (FIGS. 1*d*, 1*e*) are also displayed, on either side of the central line 32, said firing marks corresponding to the two possible moving speeds. In this case the operator chooses the firing mark (for example mark 22 in FIG. 1*d*) which corresponds to the inner or outer displacement mark used (for example mark 12 in FIG. 1*c*).

The projectile firing operation is conducted as follows: The operator re-aims his firearm in such a way as to place the target 5 at the intersection of the lines displayed by the horizontal elevation mark 33 and the adequate vertical firing mark 22 or 23 (FIGS. 1*e* and 6*e*, 8*e*, 9*e*).

In the case of FIG. 1*e*, the adequate vertical firing mark is situated on the left of the central line 32, the target moving towards the right and is constituted by the external mark 22, the displacement measuring mark used being external mark 12.

The operator then starts firing in the adequate conditions of elevation, target displacement and, if necessary, inclination.

In the case of the embodiment illustrated in FIGS. 1*a* to 1*e* using two pairs of internal and external vertical marks 11, 12 and 21, 22, it is possible to use in the display means 105 two ramps of display elements 2 of vertical marks of different colors. This enables the operator to differentiate the internal marks of a first color from the external marks of a second color, and to bring them in clear correspondence. The operaticn of selecting and lighting the display elements 2, 3 of display means 105 is conducted via the interface circuit 106.

According to the embodiment illustrated in FIG. 3, wherein the display elements 4 are constituted by a matrix of electro-luminescent diodes, for example 40 elements horizontally and 25 vertically, the different displacement marks 11, 12, 13, firing marks 21, 22, 23 and elevation marks 33 are displayed by addressing the diodes of the corresponding lines and columns. In this case, differentiating between internal and external elements or two pairs of displacement marks 11, 12 and firing marks 21, 22 may be achieved by displaying continuous lines (all diodes of one column) and discontinuous lines (for example every other diode of one column).

The time chart of the operation of the system according to the invention is diagrammatically shown in FIGS. 5*a* to 5*c*, 7*a* to 7*c*.

According to a possible sequence, once the target has appeared (point A in FIG. 5*a*) the operator starts off the computer 101 (point G in FIG. 5*b*), and after immobilizing the firearm, the cross 34 of the graticule being pointed on the target, triggers the laser range finder (point B in FIG. 5*a*) and the resetting of the chronometer (point M of FIG. 5*c*).

The computer 101 works out from the information target distance D received from the range finder (point H in FIG. 5*b*) the signals controlling the display of the displacement marks which correspond to calibrated displacement values, such as for example ±5 m and ±10 m.

The predetermined displacement marks are then displayed, (point C in FIG. 5*a* and point I in FIG. 5*b*) in the form of vertical lines, in the range finder, and will be used by the operator to control the stoppage of the chronometer by releasing for example the knob controlling the range finder (point D in FIG. 5*a* and point N in FIG. 5*c*). The time information $t_o$ of the chronometer is then given to the computer 101 (point J in FIG. 5*b*), which makes the firing correction calculations, namely a conventional calculation of elevation, possibly with temperature correction, and a lead correction calculation (point K in FIG. 5*b*) permitting to work out signals controlling the display of the firing and elevation marks (point F in FIG. 5*a* and point L in FIG. 5*b*). Firing can then take place at point F of FIG. 5*a*, after re-positioning of the firearm by the operator.

According to another possible sequence, upon the appearance of the target, the operator, having immobilized the firearm, triggers the resetting of the chronometer (point B in FIG. 7*a*).

The computer then displays the displacement marks, which are first fixed, then moving.

Once the time-measurement has stopped, (point C of FIG. 7*a*) the operator then points the center of the graticule on the target and triggers the range finding (point D in FIG. 7*a*). Elevation and target movement are then calculated, thus permitting to work out control signals for the display of the firing and elevation marks (point E in FIG. 7*a*).

The lead correction permitting the display of a firing mark at a given distance from the central line of the range finder is calculated according to the formula:

$$\sigma_o = \frac{e}{d} \; \frac{t_{flight}}{t_o} \qquad (1)$$

wherein e is the calibrated displacement value corresponding to a displacement mark, that is to say the target lateral moving distance inside a plane perpendicular to the sighting line.

$t_o$ is the measured displacement time corresponding to the displacement of the target over distance e, d is the distance between the target and the firearm, $t_{flight}$ is the projectile flight time, and $\theta_o$ is expressed in radians.

Obviously, the lead correction can also include corrections accounting for the measurement of the inclination $\alpha$ and/or for the measurement of the ambient temperature T.

Thus, for an inclination $\alpha$ below or equal in absolute value to 10 °, the lead correction $\theta$ will be :

$$\theta_1 = \theta_o + H_o\alpha \quad (2)$$

wherein $H_o$ is the elevation correction in standard conditions, expressed in radians.

The measurement of the ambient temperature T permits to determine a corrected value of the flight time $t_{flight}$ which can be substituted to the value $t_{flight}$ of formula (1) calculated in standard conditions.

The invention is in no way limited to the description given hereinabove and on the contrary covers any modifications that can be brought thereto without departing from its scope.

What is claimed is:

1. Firearm sighting device for use by an operator of a firearm with correction of lateral movement of a target, comprising:

a sight defining a focal plane and having a graticule defining a horizontal spider line within said focal plane;

first means coupled to said sight for displaying a reference mark within said focal plane at one location on the horizontal spider line;

second means coupled to said sight for displaying at least one displacement mark within said focal plane at a location on the horizontal spider line different from the location of the reference mark;

a range finder for measuring a firing distance;

a range finder control knob means for controlling said range finder;

means coupled to the range finder for calculating a projectile flight time from the measurement of the firing distance by the range finder;

means coupled to the flight time calculating means for storing said projectile flight time;

time measuring means for providing an elapsed target displacement time interval;

a first control member for starting the time measuring means and for starting said second displaying means, said first control member being adapted to be actuated by the firearm operator when the target seen in the sighting device held in a fixed position is superimposed with said reference mark;

a second control member for stopping said time measuring means and for stopping said second displaying means, said second control member being adapted to be actuated by the firearm operator when the target seen in the sighting device held in a fixed position is superimposed with said at least one displacement mark;

means controlled by said first control member for causing a predetermined displacement of said at least one displacement mark within said focal plane towards said reference mark and for starting said time measuring means;

means for inhibiting said means for causing the displacement of said at least one displacement mark upon actuation of said second control member and for stopping said time measuring means;

means for storing an elapsed target displacement time interval as measured by said starting and stopping of said time measuring means;

means for projecting a location of at least one cross velocity adjusted mark within said focal plane on said horizontal spider line in relation to the calculated projectile flight time and in relation to the calculated target displacement time; and third means for displaying said at least one cross velocity adjusted mark within said focal plane at said location on said horizontal spider line determined by said projecting means.

2. Sighting device as claimed in claim 1, wherein said first and second control members are constituted by said range finder control knob means, and the actuation of said second control member is constituted by a release of said range finder control knob means.

3. Sighting device as claimed in claim 1, wherein said second displaying means cause the display of at least one displacement mark within said focal plane at one given location on the horizontal line which is situated at a relatively great distance from the location where the reference mark is located, and said means for causing a displacement of said at least one displacement mark within said focal plane is adjusted to cause the displacement mark to have a final position which is located at a relatively short distance from the reference mark.

4. Sighting device as claimed in claim 3, wherein said means for causing a displacement of said at least one displacement mark within said focal plane is adjusted to cause a progressive movement of the displacement mark which takes place at an increasing speed from the initial position of the displacement mark to the final position thereof.

5. Sighting device as claimed in claim 3, further including delay means for enabling said means for causing a displacement of said at least one displacement mark during a preset time interval after actuation of said first control member.

6. Sighting device as claimed in claim 1, further comprising means for automatically stopping said time measuring means and said second means for displaying at least one displacement mark after a preset time interval following an actuation of said first control member.

7. Sighting device as claimed in claim 6, wherein said preset time interval is between 1 and 3 seconds.

8. Sighting device as claimed in claim 1, wherein said reference mark is constituted by a central vertical spider line of said graticule.

9. Sighting device as claimed in claim 1, wherein said reference mark is constituted by a mark which is laterally shifted from a vertical spider-line of said graticule and said first control member first causes a display of said at least one displacement mark on or close to said vertical spider line.

10. Sighting device as claimed in claim 1, wherein displacement marks, reference marks and cross velocity adjusted marks are disposed in pairs, symmetrically with respect to a control vertical spider line of said graticule whereby target sighting can be achieved without the operator having to give information as to the direction in which the target moves.

11. Sighting device as claimed in claim 1, further comprising means for measuring or detecting the inclination threshold, and means for correcting the lead as a function of the measured inclination.

12. Sighting device as claimed in claim 1, wherein reference marks, displacement marks and cross velocity adjusted marks are constituted by segments which are parallel to a central vertical spider line of said graticule.

* * * * *